US006853118B2

(12) United States Patent
Haitko et al.

(10) Patent No.: US 6,853,118 B2
(45) Date of Patent: Feb. 8, 2005

(54) CONTROL OF LEACHABLE MERCURY IN MERCURY VAPOR DISCHARGE LAMPS

(75) Inventors: Deborah Ann Haitko, Schenectady, NY (US); Stanlee Teresa Buddle, Gloversville, NY (US); David Key Dietrich, Schenectady, NY (US); Donald Franklin Foust, Scotia, NY (US)

(73) Assignee: General Electric Company, Niskayuna, NY (US)

( * ) Notice: Subject to any disclaimer, the term of this patent is extended or adjusted under 35 U.S.C. 154(b) by 281 days.

(21) Appl. No.: 09/847,198

(22) Filed: May 3, 2001

(65) Prior Publication Data

US 2002/0190646 A1 Dec. 19, 2002

(51) Int. Cl.[7] ..... H01J 17/20; H01J 5/48

(52) U.S. Cl. ..... 313/318.08; 313/639; 313/318.01; 313/490; 252/520.3

(58) Field of Search ..... 313/571, 577, 313/639, 568, 490, 562, 564, 550, 483, 484, 638–640, 318.01, 318.08, 624, 625, 565, 489; 174/17.07, 50.61, 50.62; 65/59.1, 59.4, 59.24; 428/209, 432, 434; 252/500, 518.1, 520.3

(56) References Cited

U.S. PATENT DOCUMENTS 2,873,510 A * 2/1959 Duran et al. ..... 228/124.6
3,302,961 A * 2/1967 Franklin ..... 403/272
3,755,065 A * 8/1973 Chvatal ..... 428/408
3,858,378 A * 1/1975 Allen et al. ..... 403/30
4,319,157 A * 3/1982 De Vrijer ..... 313/642
4,469,980 A * 9/1984 Johnson ..... 313/25
4,559,470 A * 12/1985 Murakami et al. ..... 313/487
5,229,686 A 7/1993 Fowler et al.
5,229,687 A 7/1993 Fowler et al.
5,409,522 A * 4/1995 Durham et al. ..... 75/670
5,460,643 A * 10/1995 Hasenpusch et al. ..... 95/134
5,599,515 A * 2/1997 Misra et al. ..... 423/101
5,801,483 A * 9/1998 Watanabe et al. ..... 313/485
5,821,682 A 10/1998 Foust et al.
5,952,780 A * 9/1999 Forsdyke et al. ..... 313/565
5,972,442 A * 10/1999 Anderson et al. ..... 428/34.5
5,986,405 A * 11/1999 De Maagt et al. ..... 313/637
6,043,603 A * 3/2000 Weinhardt ..... 313/566
6,224,446 B1 * 5/2001 Dietrich et al. ..... 445/2
2001/0020823 A1 * 9/2001 Dietrich et al. ..... 313/640

FOREIGN PATENT DOCUMENTS

JP 61240526 A * 10/1986 ..... H01J/9/395
JP 04245162 A * 9/1992 ..... H01J/61/48

* cited by examiner

*Primary Examiner*—Nimeshkumar D. Patel
*Assistant Examiner*—German Colón
(74) *Attorney, Agent, or Firm*—Toan P. Vo; Patrick K. Patnode

(57) ABSTRACT

A method and apparatus for preventing the formation of leachable mercury in mercury arc vapor discharge lamps is provided which comprises providing in the lamp structure an effective amount of a silver compound, gold compound, or combination thereof.

16 Claims, No Drawings

CONTROL OF LEACHABLE MERCURY IN MERCURY VAPOR DISCHARGE LAMPS

BACKGROUND OF THE INVENTION

The present invention relates to a method and apparatus for preventing the formation of leachable mercury in mercury arc vapor discharge lamps.

Mercury arc vapor discharge lamps, otherwise commonly known as fluorescent lamps, are standard lighting means. The mercury arc vapor discharge lamp consists of metallic components such as lead wires, connector pins and end caps. The lead wires and portions of the end cap and connector pins are surrounded by a glass enclosure. The interior of the glass enclosure is typically coated with phosphor. Elemental mercury is added to the mercury arc vapor discharge lamp and typically, the elemental mercury adheres to the phosphor. In certain conditions, it has been found that when elemental mercury comes in contact with the metal components in a lamp such as copper and iron containing lead wires, brass pins, or other associated metallic mount components, the elemental mercury is transformed into a leachable form.

In order to address the growing concern that mercury from disposal of fluorescent lamps might leach into surface and subsurface water, the Environmental Protection Agency has established a maximum concentration level for mercury at 0.2 milligrams of leachable mercury per liter of extract fluid. The concentration level for mercury is generally determined by a standard analysis known as the Toxicity Characteristic Leaching Procedure (TCLP), a well known test procedure implemented in 1990 by the Environmental Protection Agency.

When carrying out the TCLP test, test lamps are pulverized to form lamp waste material similar to that which would result from lamp disposal in land fills or other disposal locations. The ambient conditions in disposal locations may be such as to promote formation of leachable mercury. The TCLP test conditions themselves tend to allow for formation of leachable mercury in amounts greater than the established limit of 0.2 milligrams per liter.

During the disposal of the lamp, and in the TCLP test, the glass enclosure of the lamp is broken. Elemental mercury that is contained in the lamp is then exposed to the metal components in an aqueous environment. Elemental mercury, when exposed to both the metal components and the aqueous environment, is oxidized to leachable mercury. The metal components in the lamp provide the source of oxidizable iron and oxidizable copper that promotes the formation of leachable mercury.

Several techniques have been developed which prevent the formation of mercury that can leach into the environment. The methods currently used are concerned with a method of delivering a chemical agent or metal upon disposal of a lamp or during the TCLP test. For instance, Fowler et al. (U.S. Pat. No. 5,229,686 and U.S. Pat. No. 5,229,687) describe methods that incorporate chemical agents in the lamp in either a glass capsule or the basing cement. These chemical agents include various salts such as bromide anions, chloride anions, iodide anions, iodate anions, periodate anions, and sulfide anions, to name a few. Other chemical agents include powders such as iron powder, copper powder, tin powder, and titanium powder.

In U.S. Pat. No. 5,821,682, which has been assigned to the assignee of the present invention, Foust et al. describe the addition of a mercury antioxidant for superior TCLP test performance. Mercury antioxidants include, for example, ascorbic acid, sodium ascorbate, and sodium gluconate. These materials have been found to reduce or prevent the formation of leachable mercurous and mercuric compounds resulting from the oxidation of elemental mercury. Unfortunately, manufacturing processes typically use a separate dispensing step to introduce the mercury antioxidant.

Generally, any modification of the lamp components is driven by the need to decrease the amount of leachable mercury. Methods and materials are constantly being sought which decrease the leachable mercury values upon performance of the TCLP extraction test.

SUMMARY OF THE INVENTION

The present invention provides a mercury vapor discharge lamp comprising an effective amount of a silver compound, a gold compound or combination thereof.

The present invention further provides a method for preventing the formation of leachable mercury compounds in mercury vapor discharge lamps comprising providing in the lamp structure an effective amount of a silver compound, a gold compound or combination thereof.

DETAILED DESCRIPTION

The incorporation of a silver compound, a gold compound, or combination thereof has been found to have a significant effect on preventing mercury compounds from leaching during the TCLP test. Accordingly, the formation and dissolution of soluble ferric and cuprous ions from the mercury vapor arc discharge lamp components is diminished or prevented resulting in reduction or prevention of leachable mercury compounds.

Lead wires are typically made of iron or copper and connector pins are typically made of brass. The lead wires and connectors pins are the source of elemental iron ($Fe^0$) and copper ($Cu^0$) which is oxidized in the presence of oxygen and an aqueous environment to ferric ($Fe^{+3}$) and cuprous ($Cu^{+1}$) ions. Ferric and cuprous ions can then dissolve in aqueous solution. The presence of ferric and cuprous compounds has been found to lead to the formation of leachable mercury.

"Leachable mercury" as used herein refers to elemental mercury ($Hg^0$) which has been oxidized. Oxidized mercury reacts with oxygen to form compounds such as mercuric oxide (HgO). Once the lamp has been broken and the elemental mercury can oxidize to leachable mercury, the leachable mercury can be carried via groundwater, rivers and streams.

Suitable silver compounds include, for example, silver carbonate, silver halides, silver oxide, silver sulfide, silver acetate, or combinations thereof. Suitable gold compounds, include, for example, gold carbonate, gold halide, gold oxide, gold sulfide, gold acetate, or combinations thereof. Typically, silver carbonate is used in the present invention.

To prevent the spurious formation of leachable mercury upon disposal of mercury vapor discharge lamps and to improve the reliability of the TCLP test, an effective amount of a silver compound, gold compound, or combination thereof is incorporated in the lamp structure, for example within the glass envelope exterior to the plasma discharge, in an end-cap, or in the base of the lamp. An effective amount of the silver compound, gold compound, or combination thereof is that amount which will substantially prevent the interaction of elemental mercury with ferric and cuprous compounds that can oxidize elemental mercury to a soluble form. In general, an effective amount of the silver compound, gold compound, or combination thereof will be enough for the TCLP test results to show the presence of less than about 0.2 parts per million of leachable mercury per lamp. Typically, the silver compound, gold compound, or combination thereof is present in a range between about 0.1 milligrams and about 10 grams per lamp, and more typically, in a range between about 10 milligrams and about 30 milligrams per lamp.

The silver compound, gold compound, or combination thereof is typically incorporated in the basing cement of the lamp that holds the aluminum cap to the leaded glass portion of the end of the lamp. The basing cement generally comprises about 80 weight % marble flour (limestone-CaO), and the balance shellac a phenolic resin binder, a solvent for blending, and a dye used to color the cement. The cement is dispensed through a feeder into the base and heated to cure once assembled with the lamp. The curing drives off the solvent and solidifies the cement. The silver compound, gold compound, or combination thereof is blended with the cement components and incorporated into a lamp manually or by automated manufacturing equipment. The silver compound, gold compound, or combination thereof is released only when the lamp is destroyed or crushed in preparation for TCLP testing. In this method, the silver compound, gold compound, or combination thereof is always exterior to the positive column of the lamp. The positive column is a typically under vacuum and is a portion of the lamp that includes the interior of the stem press (inner leads and cathode) which is filled with phosphor and inert gases that fill the lamp. Inert gases that fill the lamp typically include argon and krypton. By incorporating the silver carbonate, gold carbonate, or combination thereof within the basing cement of the end cap, no separate dispensing step to introduce the silver compound, gold compound, or combination thereof is necessary.

The silver compound, gold compound, or combination thereof can also be formulated into a thermally curable adhesive or binding composition which is soluble in acidic aqueous solutions. Such compositions generally include an inert filler material, a binder such a polyvinymethacrylate, and a processing solvent such as denatured alcohol. The alcohol will evaporate and the composition will cure when the basing cement is cured. These ingredients are similar to the usual components of basing cements used to secure the glass envelope to the aluminum base or end cap. Gums and gelatins have also been used as such adhesives and binders. The nature of the gums and gelatins is that they adhere to surfaces when heated. The composition containing the antioxidant material can be placed on the inner surface of the aluminum end cap as a ring or discrete button. When the lamp is crushed and exposed to an aqueous environment or placed in the TCLP solution, the aqueous soluble binder allows the silver compound, gold compound, or combination thereof to be released quickly.

Typical fillers include marble flour (calcium oxide). The binder material can be shellac, rosin synthetic resins such as phenolic resin. Processing solvents are generally lower alcohols such as ethyl, propyl, butyl, or amyl alcohol.

The silver compound, gold compound, or combination thereof can also be incorporated in the lamp by encapsulation of the material in a glass capsule that can be placed either in the base of the lamp between the aluminum cap and flare of leaded glass, or placed within the positive column of the lamp. Since the silver compound, gold compound, or combination thereof is enclosed in a glass capsule, it could be present in the inside of the positive column of the lamp without affecting lamp function.

The invention is illustrated by testing of mercury vapor arc discharge lamps via the TCLP test in which silver carbonate was added to the lamp components. These examples are to be regarded as non-limiting.

All TCLP test data was obtained by the test procedure prescribed on pages 26987–26998, volume 55, number 126 of Jun. 29, 1990 issue of the Federal Register.

Briefly, lamps being tested with the TCLP test were pulverized into particulate form having the prescribed particle size which is capable of passing through a ⅜ inch sieve. The test material was then extracted with a sodium acetate-acetic acid buffer at a pH of about 4.93.

Varying amounts of silver carbonate were added to the TCLP test to determine the effectiveness of the silver salt on reducing the amount of leachable mercury formed during the TCLP test. The data in Table 1 shows that levels as low as 10 milligrams of silver carbonate per lamp reduced leachable mercury to below the regulatory limit of 0.2 parts per million per lamp when either a F32T8SCSP35 lamp or F40T12 Cool White WattMiser lamp (both available from GE Lighting) was mercury dosed at 20 milligrams per lamp. One of the most important advantages of using silver carbonate is the fact that the milligram quantities of silver carbonate required can be easily incorporated within the basing cement of the end cap. No separate steps were required to add silver carbonate to the basing cement. TCLP test results using silver carbonate within the basing cement are shown in Table 1.

Undosed F32T8SCSP35 lamps (hereinafter referred to as "F32") and F40T12 (hereinafter referred to as "F40") Cool White WattMiser lamps were used for screening the additives. Technical grade and 99% silver carbonate ($Ag_2CO_3$) were purchased from Aldrich Chemicals and were not purified prior to use. Standard TCLP protocol was followed with modifications for lamp testing made according to the Scientific Applications International Laboratory's study of fluorescent lamp/TCLP testing commissioned by the Environmental Protection Agency as described in "Analytical Results of Mercury in Fluorescent Lamps," by SAIC, EPA Contract No. 68-WO-0027, May 15, 1992. Results of various amounts of silver carbonate ($Ag_2CO_3$) added to the 20 milligram mercury (Hg) dosed F40 and F32 lamps can be seen in Table 1.

TABLE 1

| Sample # | Amount $Ag_2CO_3$ added (mg) | Leachable Hg for F40 (ppb) | Leachable Hg for F32 (ppb) |
|---|---|---|---|
| 1 | 50 | <25 | |
| 2 | 10 | 60 | |
| 3 | 5 | 70 | |
| 4 | 50 | | <25 |
| 5 | 20 | | <25 |
| 6 | 10 | | 33 |
| 7 | 5 | | 40 |
| 8 | 0 | 441 | |
| 9 | 0 | | 512 |

As seen in Table 1, 5 milligrams of silver carbonate reduced the amount of leachable mercury in the F40 and F32 lamps by more than one-sixth and one-twelfth respectively compared to when silver carbonate was not added to the lamps. In addition, 50 milligrams of silver carbonate effectively reduced the amount of leachable mercury for both lamps to less than 25 parts per billion (ppb) per lamp.

While embodiments have been shown and described, various modifications and substitutions may be made thereto without departing from the spirit and the scope of the invention. Accordingly, it is to be understood that the present invention has been described by way of illustration and not limitation.

What is claimed is:

1. A low-pressure mercury vapor discharge lamp comprising an end cap that is attached to a glass enveloped with a sealing composition that consists of a silver compound, a gold compound or combination thereof.

2. A low-pressure mercury vapor discharge lamp comprising an end cap that is attached to a glass envelope with a sealing composition that comprises a silver compound, a gold compound or combination thereof, wherein said silver compound comprises silver carbonate, silver halide, silver sulfide, silver acetate, or combinations thereof.

3. The low-vapor pressure mercury vapor discharge lamp of claim 2, wherein said silver compound, gold compound, or combination thereof is present in a range between about 10 milligrams and about 30 milligrams per lamp.

4. The low-pressure mercury vapor discharge lamp of claim 2, wherein elemental mercury in said lamp is substantially incapable of interacting with ferric and cupric compounds present in said lamp to produce soluble mercury in a presence of said silver compound, gold compound, or combination thereof.

5. A fluorescent lamp comprising an amount of silver carbonate in a range from about 0.1 milligram to about 30 milligrams.

6. A fluorescent lamp comprising an amount of gold compound in a range from about 0.1 milligram to about 30 milligrams, said gold compound comprising gold carbonate, gold halide, gold oxide, gold sulfide, gold acetate, or combinations thereof.

7. A mercury vapor discharge lamp comprising an amount of silver carbonate in a range between about 10 milligrams and about 30 milligrams per lamp to substantially prevent the interaction of elemental mercury with ferric and cupric compounds which oxidize elemental mercury to a soluble form.

8. A method for preventing the formation of leachable mercury compounds in a mercury vapor discharge lamp, said method comprising providing a sealing composition between an end cap and a glass envelope of said lamp, said sealing composition comprising a silver compound, gold compound, or combination thereof; wherein said silver compound is selected from the group consisting of silver carbonate, silver halide, silver sulfide, silver acetate, and combinations thereof.

9. The method of claim 8, wherein said silver compound, gold compound, or combination thereof is present in a range from about 10 milligrams to about 30 milligrams per lamp.

10. The method of claim 8, wherein elemental mercury in said lamp is substantially incapable of interacting with ferric and cupric compounds present in said lamp to produce soluble mercury in a presence of said silver compound, gold compound, or combination thereof.

11. A method for preventing the formation of leachable mercury compounds in a mercury vapor discharge lamp, said method comprising providing a sealing composition between an end cap and a glass envelope of said lamp, said sealing composition consisting of a silver compound, gold compound, or combination thereof, wherein said silver compound comprises silver carbonate, silver chloride, silver oxide, silver sulfide, silver acetate, or combinations thereof.

12. A method for preventing the formation of leachable mercury compounds in a mercury vapor discharge lamp, said method comprising providing, in a structure of said lamp, between about 0.1 milligram and about 30 milligrams of silver carbonate.

13. A method for preventing the formation of leachable mercury compounds in a mercury vapor discharge lamp, said method comprising providing, in a structure of said lamp, between about 0.1 milligram and about 30 milligrams of a gold compound that comprises gold carbonate, gold halide, gold oxide, gold sulfide, gold acetate, or combinations thereof.

14. A method for preventing the formation of leachable mercury compounds in mercury vapor discharge lamps comprising providing an amount of silver carbonate in a range between about 10 milligrams and about 30 milligrams per lamp to substantially prevent the formation of ferric and cupric compounds which oxidize elemental mercury to a soluble form.

15. A mercury vapor discharge lamp comprising a material selected from the group consisting of silver compounds, gold compounds, and combinations thereof; said material being encapsulated and disposed at a location selected from the group consisting of a base of said lamp and an interior of said lamp; wherein said silver compounds are selected from the group consisting of silver carbonate, silver halide, silver sulfide, silver acetate, and combinations thereof.

16. A mercury vapor discharge lamp comprising a material selected from the group consisting of silver compounds, gold compounds, and combinations thereof; said material being disposed at a base of said mercury vapor discharge lamp; wherein said silver compound is selected from the group consisting of silver carbonate, silver halide, silver sulfide, silver acetate, and combinations thereof.

* * * * *